US005581834A

United States Patent [19]

Collins

[11] Patent Number: 5,581,834

[45] Date of Patent: Dec. 10, 1996

[54] FOLDING KNIFE AND TOOL DEVICE

[76] Inventor: Walter W. Collins, P.O. Box 100, North, S.C. 29112

[21] Appl. No.: 373,590

[22] Filed: Jan. 17, 1995

[51] Int. Cl.[6] ..... B26B 11/00; B26B 1/04

[52] U.S. Cl. ..... 7/118; 7/165; 7/158; 30/161; 30/155; 81/439

[58] Field of Search ..... 7/118, 138, 158, 7/165, 167–168; 81/437–440, 177.4, 490, 124.5; 30/122, 123, 143, 151, 154–155, 160–161, 164

[56] References Cited

U.S. PATENT DOCUMENTS

| | | | |
|---|---|---|---|
| 278,951 | 6/1883 | Hartman | 7/158 X |
| 825,063 | 7/1906 | Lawbaugh | 7/165 X |
| 1,512,689 | 10/1924 | Hermann | 30/161 |
| 2,633,768 | 4/1953 | Saxby . | |
| 2,798,290 | 7/1957 | Bassett | 7/118 X |
| 2,804,790 | 9/1957 | Kuc et al. . | |
| 3,364,508 | 1/1968 | Garrett . | |
| 3,943,801 | 3/1976 | Yates . | |
| 4,447,950 | 5/1984 | Mizelle | 30/155 |
| 4,815,346 | 3/1989 | Littlehorn | 81/439 |
| 4,819,289 | 4/1989 | Gibbs . | |
| 4,896,424 | 1/1990 | Walker | 30/161 X |
| 5,060,379 | 10/1991 | Neely . | |
| 5,095,624 | 3/1992 | Ennis | 30/161 |
| 5,153,995 | 10/1992 | Opinel . | |

FOREIGN PATENT DOCUMENTS 2254433 5/1974 Germany .

OTHER PUBLICATIONS

P. 54, Nov. 1994, issue of *Blade* magazine, "The Second Locking Notch", Gary Keller.

Buck Knives advertisement from Nov. 1994 *Blade* magazine, "CrossLock" made by Buck Knives.

*Primary Examiner*—D. S. Meislin

*Attorney, Agent, or Firm*—Leatherwood Walker Todd & Mann

[57] ABSTRACT

A combination knife and tool set device having a handle member in which a blade and tool members are pivotally connected. A swinging lock lever is provided for locking the blade in an extended position through entry of the locking member into the blade cavity and abutment thereof against the end of the blade. Retraction of the blade is enabled by one-handed operation of both the locking lever and the blade. Tool members are provided in a tool member cavity at the other end of the handle and may be pivoted outwardly and locked in a variety of extensions and locked in place by a threaded locking set.

12 Claims, 5 Drawing Sheets

FOLDING KNIFE AND TOOL DEVICE

BACKGROUND OF THE INVENTION

This invention relates generally to a folding knife having tools provided therein.

Folding knives have been available for some time and offer the basic feature of a compact cutting tool which may be readily carried in the user's pocket, purse, or other small compartment. Folding knives also offer the advantage, as compared to fixed blade knives such as sheath knives, kitchen knives, or the like, in that while the blade of a folding knife is in a retracted position, it is safely carried within the blade compartment of a handle. Therefore, no separate sheath or other protective covering is required. Accordingly, folding knives allow the advantages of providing, when the blade is in extended position, a useable cutting tool, and when in a retracted position, a self-contained protective housing in the form of the folding knife handle.

A typical disadvantage of a folding knife, as compared to a fixed blade knife, is that the blade of a folding knife may not lock when in the extended position, thereby presenting a potential risk of closure or partial closure of the blade into the handle when in use. Such closure could, of course, injure the user of the knife. While folding knives are available having a mechanism for locking the blade in an extended position, such folding knives often require the user to use both hands in order to release the locking mechanism for closing the blade into the handle. Conventional folding knife locking mechanisms may also be of a construction requiring tightly toleranced parts and construction methods, in addition to requiring numerous and relatively expensive parts for construction.

Turning now to the background for the tool aspect of the present invention, it is desirable to provide a compact arrangement of tools which can be carried in a toolbox, glove compartment of an automobile, desk, kitchen drawer, or preferably, in the user's pocket. By providing a number of tools in a compact arrangement, the user can perform a number of different operations using the single, compact design. The user may desire to have a particular arrangement of tools to perform particular types of services. For example, the user may want to have a compact arrangement of tools to perform mechanical or electrical repairs of a general nature, or may want to have a tool arrangement for performing specific functions, such as for firearm repair and adjustment, or for boating repairs, automotive work, instrument adjustments, etc.

Various folding knife configurations have been patented, and include U.S. Pat. No. 5,060,379, issued to Neely, which discloses a folding knife having a blade with a slot which acts in cooperation with a pin and spring to selectively lock the blade in an extended position. German patent Offenlegungsschrift 2,254,433, discloses a pocketknife spring housing having a spring operating piece for allowing a square tool pivot to latch in use in transport positions. A housing is provided constructed of plastic and/or metal. U.S. Pat. No. 5,153,995, issued to Opinel, discloses a folding knife having a spring molded to an intermediate member, which is pressed into a wood handle.

Also known are folding knives having a liner lock, wherein a metal liner is provided in a blade handle and the liner includes a biased cantilevered portion for locking an outwardly extending blade.

Patented knife and tool combinations include U.S. Pat. No. 4,819,289, issued to Gibbs, which discloses a handle having a blade member and a tool member. U.S. Pat. No. 3,364,508, issued to Garrett, discloses a golfer's tool having blade and tool member implements.

Tool arrangements in a relatively compact form are disclosed in U.S. Pat. No. 2,633,768, issued to Saxby, which discloses Allen wrenches extending from hub members. U.S. Pat. No. 3,943,801, issued to Yates, discloses a tool set having tool members which may be extended from a tool-holding body. U.S. Pat. No. 2,804,970, issued to Kuc, et al., discloses a wrench holder having bolts for carrying hex keys and wrenches thereon.

While the foregoing designs are known, there still exists a need for a folding knife having a positively locking blade and tool members which can be selectively locked in extended positions during use.

SUMMARY OF THE INVENTION

It is, therefore, the principal object of this invention to provide a folding knife and tool device.

It is another object of the present invention to provide a folding knife and tool device having means for locking a blade in an extended position.

It is another object of the present invention to provide a folding knife and tool device having a plurality of extendable tools.

It is another object of the present invention to provide a folding knife and tool and device having tool locking means for locking tools in a desired position.

It is another object of the present invention to provide a blade locking device which pivots into the blade compartment of a knife handle for locking a blade in an extended position.

It is still another object of the present invention to provide a folding knife and tool device having a molded backspring.

It is still another object of the present invention to provide a folding knife and tool device having a spring-biased lever for maintaining a blade in a retracted position within a knife handle.

It is still another object of the present invention to provide a threaded tool locking member for locking tool members in a variety of positions.

It is still further an object of the present invention to provide a method of unlocking a blade of a knife.

It is a further object of the present invention to provide a method for locking tool members with respect to a tool member holder.

It is still a further object of the present invention to provide a method of assembling a folding knife and tool device constructed in accordance with the present invention.

Generally, the present invention includes a locking mechanism for a folding implement having a handle defining an implement compartment and an implement pivotally connected to the handle for pivoting between a retracted position, at least partially within the implement compartment, and an extended position extending outwardly from the handle. The implement has at least one end substantially exposed to the implement compartment when in the extended position. The locking mechanism includes a locking member having two ends, one of the ends being pivotally connected to the handle for movement within the implement compartment between an unlocking position, for allowing movement of the implement with respect to the handle, and a locking position, for contacting the end of the implement and substantially fixing the implement against motion with respect to the handle.

The present invention further includes a tool and implement holder, comprising an elongated body member having two ends, a top portion and a bottom portion, and first and second side portions. The body member defines an elongated implement cavity and includes a first implement pivotally connected to the body member for pivoting movement substantially within a first plane between an extended position, extending outwardly from the body member, and a retracted position, wherein the first implement is received in the implement cavity of the body member.

At least one tool member is included, which is pivotally connected to the body member for pivoting substantially in a second plane with respect to the first side portion of the body member, the second plane extending at an angle with respect to the first plane. The tool member is configured for pivoting between an extended position, extending outwardly from the first side of the body member, and a retracted position, wherein the tool member is substantially adjacent to the first side of the body member.

More specifically, the present invention includes a threaded locking member for selectively locking tool members with respect to the body member. The present invention further includes methods for assembling a folding knife and tool device, for unlocking an extended blade, and for locking and unlocking tool members with respect to the handle of a knife.

BRIEF DESCRIPTION OF TEE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
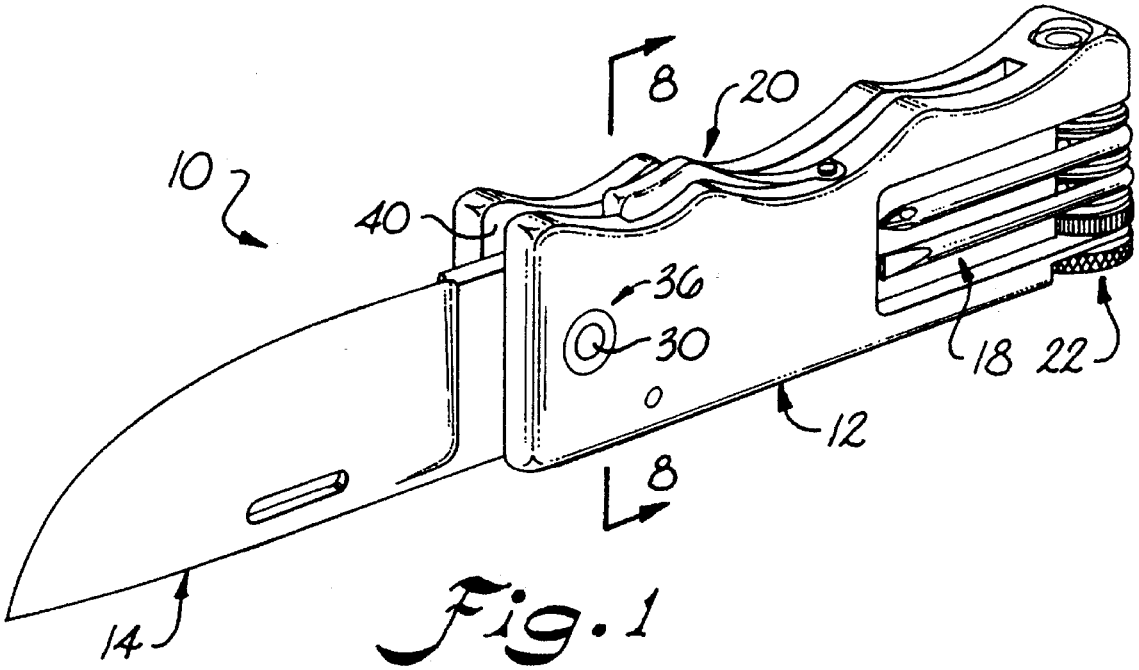
FIG. 1 is a perspective view of a folding knife and tool device constructed in accordance with the present invention.

The accompanying drawings and the description which follows set forth this invention in a preferred embodiment. However, it contemplated that persons generally familiar with knife and tool designs will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the knife and tool device of the present invention is indicated generally in the figures by reference character 10.

Figure 5:
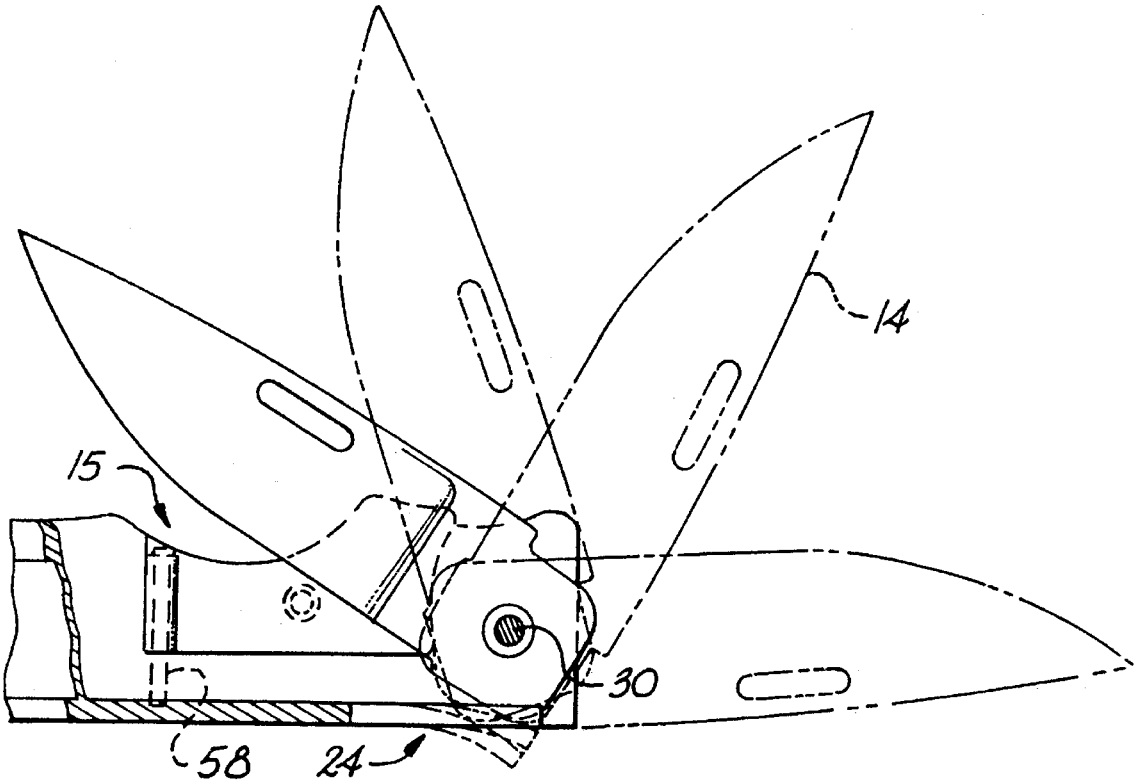
FIG. 5 is a partial side elevational view of a folding knife and tool device constructed in accordance with the present invention illustrating a knife blade in several stages of extension and also movement of an integral back spring.
Figure 6:
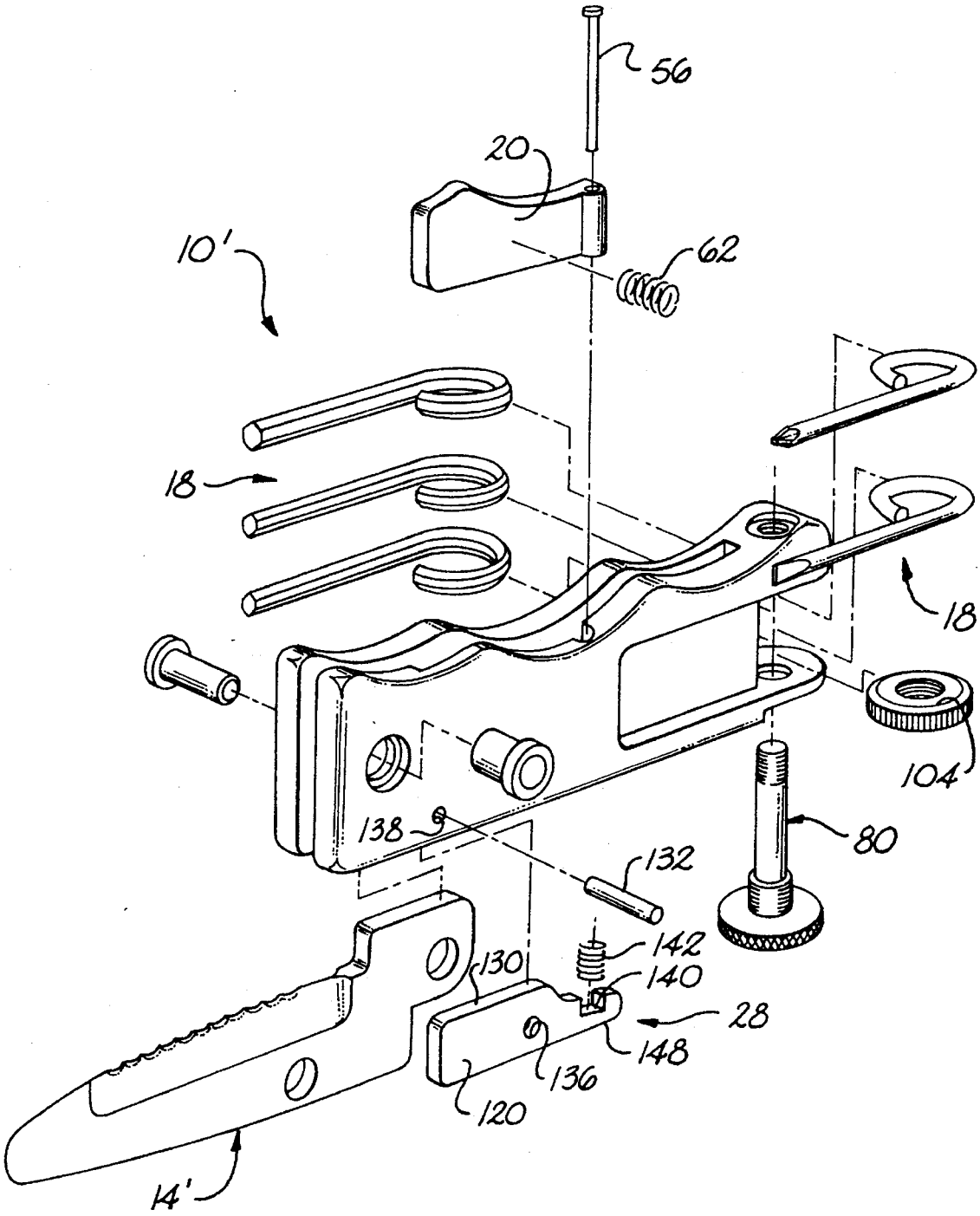
FIG. 6 is an exploded view of an alternate embodiment of a folding knife and tool device constructed in accordance with the present invention.
Figure 7:
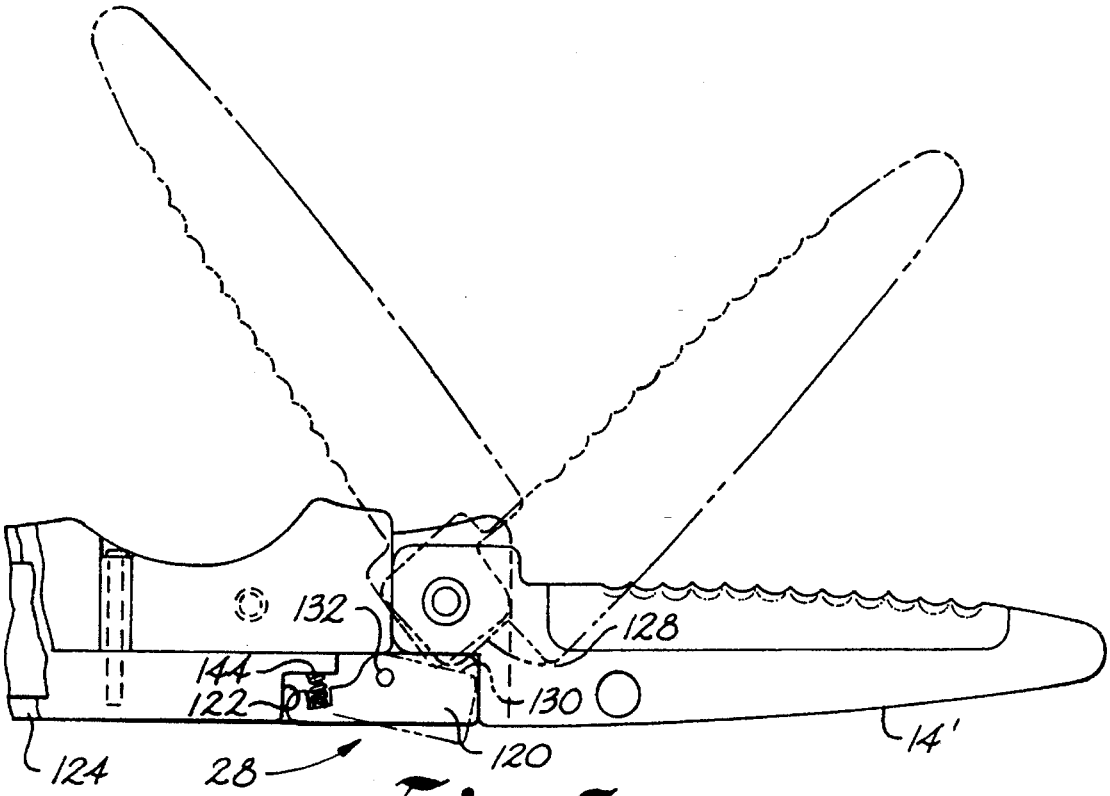
FIG. 7 is a partial sectional side elevational view of the folding knife and tool device illustrated in FIG. 6.
Figure 8:
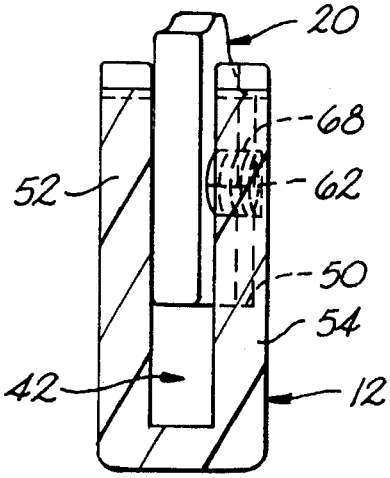
FIG. 8 is a sectional view taken along lines 8—8 of FIG. 1.

Turning to FIG. 1, the knife and tool device 10 is illustrated having a body member, or handle, generally 12, an implement, or blade, generally 14, a plurality of tools, generally 18, a blade locking member, generally 20, and a tool locking arrangement, generally 22. As illustrated in FIG. 5, knife and tool device 10 includes a back spring, generally 24, preferably formed integrally with handle 12. Alternately, as shown in FIGS. 6 and 7, back spring-type means are provided in the form of a locking lever system, generally 28.

Knife and tool device 10 (referred to hereinafter simply as "knife 10") is illustrated in FIG. 1 with blade 14, having cutting edge 15, being in an extended position extending outwardly from handle 12. A pivot pin 30 is provided which extends through apertures, generally 32, in handle 12 and through an aperture 34 in one end of blade 14. A bushing member 36 is also provided for use in connection with pin 30 and together form a press rivet set such that pin 30 and bushing 36 are securely held with respect to handle 12. Alternately, press rivet set, generally 38, could be configured to rotate with respect to handle 12 if desired.

Figure 2:
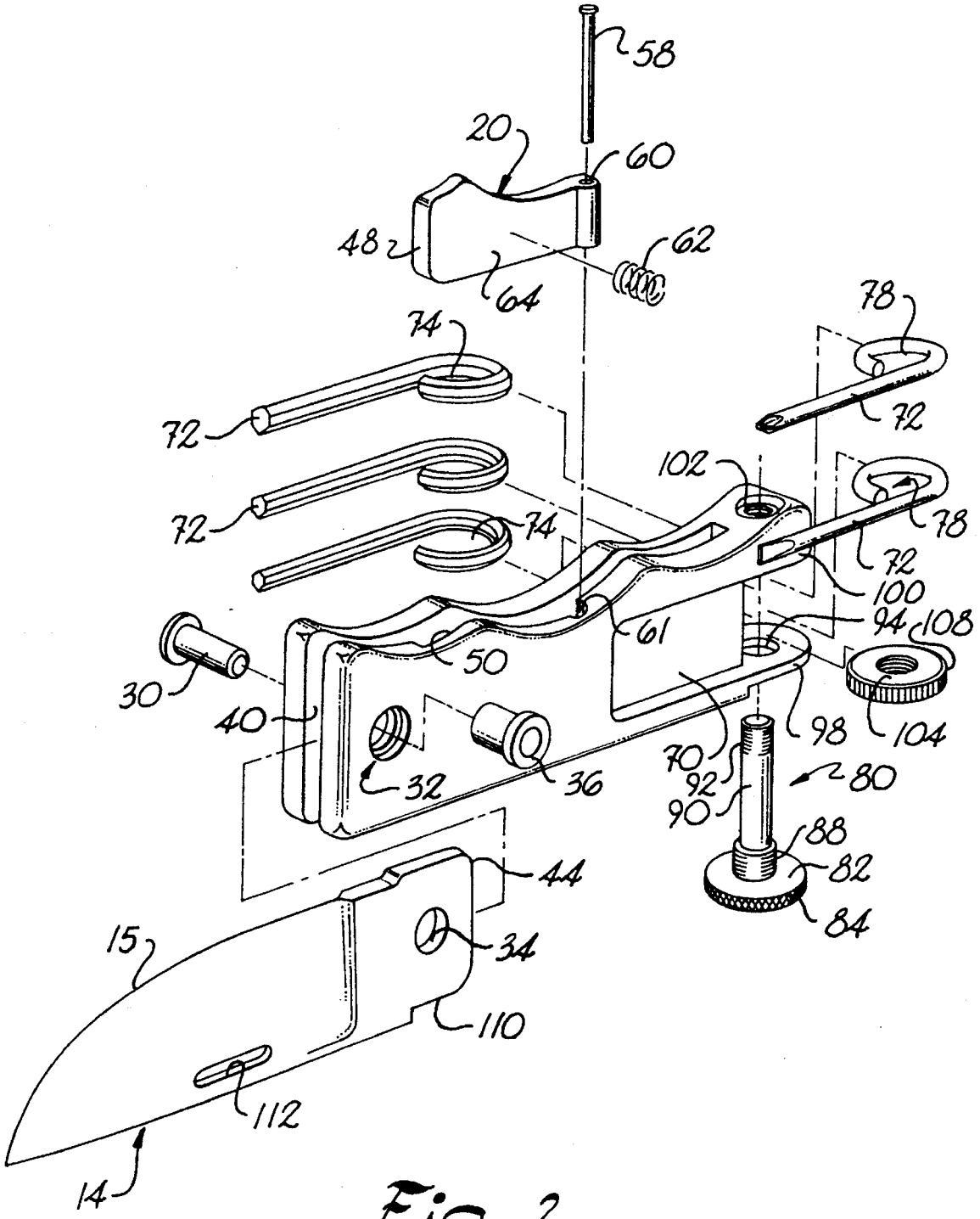
FIG. 2 is a an exploded view of a folding knife and tool device constructed in accordance with the present invention.
Figure 4:
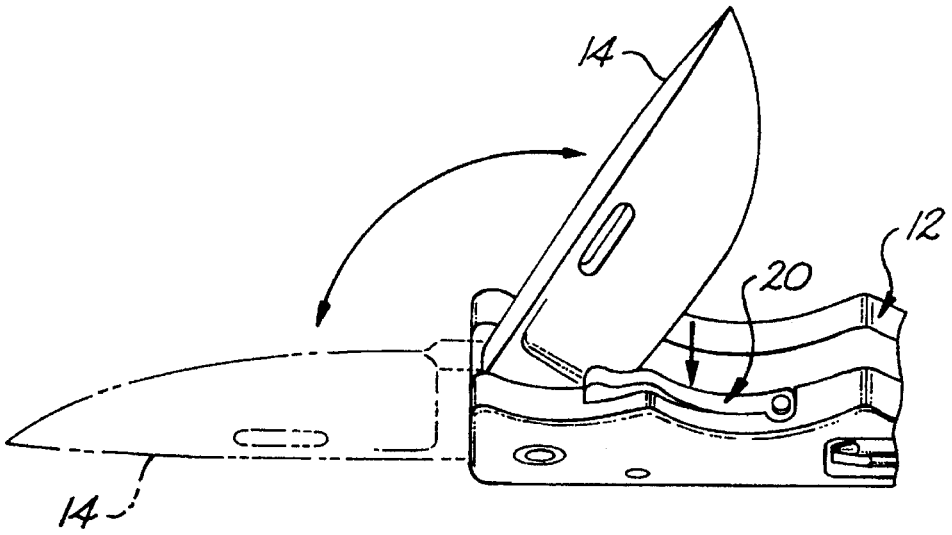
FIG. 4 is a partial perspective view of a folding knife and tool device constructed in accordance with the present invention showing movement of a knife blade.

Blade 14, having cutting edge 15, extends outwardly through a blade opening 40 defined in one end of handle 12, when blade 14 is an extended position. As indicated in FIGS. 4 and 5, blade 14 can move from an extended position as shown in FIG. 1, to a retracted position within a blade cavity, generally 42, provided in handle 12. As shown in FIGS. 1 and 2, when blade 14 is shown in its extended position, locking member 20 extends inwardly into the blade cavity 42 and is closely adjacent to, and preferably contacts, the rear end edge 44 of blade 14. Because the end 48 of the locking member 20 and the rear end 44 of the blade are in substantial parallel contact with one another, blade 14 is substantially prevented from movement from the retracted position until locking member 20 is moved out of the blade cavity.

Figure 3:
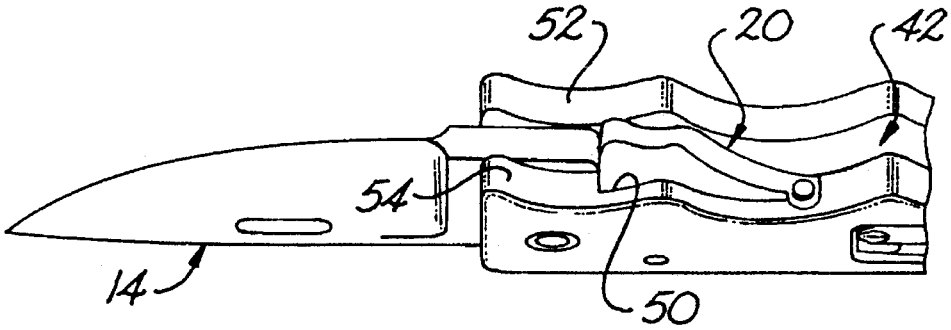
FIG. 3 is a partial perspective view of a folding knife and tool device constructed in accordance with the present invention.

In the embodiment shown in FIG. 3, locking member 20 would be moved downwardly into a locking member recess 50 defined in one of the walls 52, 54 of handle 12 bordering the blade cavity 42. Of course, it is to be understood, that locking member 20 could be provided on the opposite wall 52 of the blade cavity for movement with respect to such wall, if desired, instead of wall 54 as illustrated. Also, while the forward edge 48 of locking member 20 and the rearward edge 44 of blade 14 have been indicated as extending substantially vertically, for example, in FIG. 2, it is to be understood that different cooperating profiles could be provided on the respective ends 44, 48 of locking member 20 and blade 14 other than straight surfaces, if desired. For example, the rear end of blade 14 could be provided with a concave portion, and the forward end of locking member 20 could be provided with a convex portion (not shown) which would matingly engage with the concave of blade 14 to securely lock blade 14 in a desired position. It is to be further understood that the rear end of blade 14 could be provided with several mating teeth or other profiles (not shown) so that blade 14 could be locked in intermediate positions between its retracted and extended positions by locking member 20.

Locking member 20 preferably pivots about a pin 58, which is received in a passage provided in a partially cylindrical rearward end 60 thereof. Pin 50 is fixedly located at the base of a partially cylindrical recess 61 (which receives end 60) of handle 12 by means of a press-fit and/or through the use of adhesive, although other means of fixation could also be used. A spring 62 is interposed between the interior locking surface 64 of member 20 and a spring cavity 68 defined in the locking member recess 50. Although spring 62 is illustrated as a coil spring, it is to be understood that a leaf spring could also be used, or some other type of spring arrangement, if desired. For example, a locking lever 20 could be formed integrally with the handle in a cantilever fashion without requiring the use of any additional spring. For example, handle 12 is preferably molded from plastic, glass-filled nylon, or some other suitable material, and if so molded, cantilever spring-type locking member could be molded integrally with the handle.

When it is desired to move blade 14 from its extended position to a retracted position, locking member 20 is pivoted against the force of spring 62 into recess 50, such that the forward end of member 48 clears the rearward end 44 of the blade. Blade 14 may then be pivoted into its retracted position within blade cavity 42. It is important to note that this entire sequence can be performed by the user using only one hand. The user first moves the locking lever to its unlocking position within the locking member recess with his or her thumb or other finger. While keeping the locking member in such an unlocking position, the user will use another of his or her fingers on the same hand to pivot the blade into the handle.

Turning now to the tool aspect of the present invention, a plurality of tools 18 are provided in the handle, preferably on the opposite end of the handle from where blade 14 is pivotally connected thereto. Tools 18, when in a retracted position, are received within a tool cavity 70 defined in at least one side wall 52, 54 of handle 12. Although not shown, another tool cavity is preferably formed in the opposite side of handle 12 in addition to the tool cavity 70 illustrated for receipt of tools 18. Individual tool members 72 are provided with a receptacle 78 for receipt of an elongated threaded member, or tool arbor, 80. Tool arbor 80 includes an enlarged head portion 82, preferably having a knurled peripheral portion 84 which allows engagement by a user's fingers. Extending adjacent to the enlarged portion is a threaded portion 88 which is of a first diameter and extending, as illustrated in FIG. 2, upwardly from the first threaded portion is a shaft portion 90 which is received in the respective receptacles of the tool member and about which tool members 72 may pivot. Adjacent to the shaft portion is a second threaded portion 92 which is of a smaller diameter than the first threaded portion 88.

In assembling the tool members 72 on handle 12, the tool arbor 80 is inserted in a lower opening 94 defined in a first outwardly extending arm 98 of handle 12 and the tool arbor then passes through the receptacles 78 of tool members 72, which are held in the area between arms 98, 100 extending outwardly from the rear of handle 12. Second threaded portion 92 of tool arbor 80 is threadingly received in a threaded portion, preferably a threaded insert 102, provided in the second arm of handle 12.

In a preferred arrangement, however, a threaded adjustment nut 104, also having a knurled periphery 108, is threadingly connected to a first threaded portion 88 of tool arbor 80 when such extends into the space between the two arms 98, 100. By virtue of arms 98,100 and the configuration of the tools, the tools may pivot through an arc of slightly less than 360 degrees, and because of the tool arbor design, the tools can be locked in virtually any desired angular relationship with handle 12. In assembling knife 10, the tool members are then provided adjacent adjustment nut 104 prior to second threaded portion 92 being received by threaded insert 102. This arrangement allows for the tools to be selectively pivoted one at a time, or more than one at a time, if desired, to selected positions of extension from tool cavity 70 simply by turning adjustment nut 104 about the first threaded portion of tool arbor 88. To allow release of the tools, the adjustment nut is turned in the direction to move it away from the tools, and to lock the tools in a particular position, the adjustment nut is simply rotated in the opposite direction. This arrangement allows for the tools to be tightly held both while in extended and retracted positions, and is particularly important when the tools are in the retracted position, as it prevents the tools from rattling or being loosely held within tool cavity 70 when not in use. Alternately, although not shown, tool cavity could be provided with resilient clips which would project outwardly slightly from cavity 70 for snugly engaging the tools when they are in a retracted configuration.

Another feature of the present invention is an integral back spring 24, illustrated in FIG. 5. Back spring 24 has as its primary purpose the retention of blade 14 when blade 14 is in its retracted position within blade cavity 42 of handle 12. In other words, back spring 24 prevents the blade from falling, or "flopping", out of the handle when not in an extended position. Back spring 24 is preferably integrally molded in the bottom portion of handle 12, and is preferably constructed of the same material, such as plastic or glass-filled nylon, as is the handle. Back spring 24 bears against the lower edge 110 of the rear end of the blade when the blade is in the retracted position to maintain the blade in the retracted position. When the blade is moved to the extended position, the user must work against the back spring in order to pull the blade out of the blade cavity. It is noted that a slot 112, protuberance, or nail mark may be provided near the upper edge of the blade to aid the user in gaining purchase on the blade when extracting the blade from the blade cavity.

A further embodiment of the knife and tool device is indicated in FIGS. 6 and 7 and is designated generally as 10'. This embodiment uses an alternate version of a back spring-type device instead of the molded-in back spring 24 discussed above. Although, it is to be understood, that a conventional metal back spring, which extends a significant portion of the length of the handle could be used instead of either of these two back springs, if desired. The alternate back spring version of FIG. 6 includes a pivoting lever 120, which is pivotally connected to a recess 122 defined in the bottom portion 124 of the handle and which engages the lower edge 128 of the rear end of the blade to keep the blade within a retracted position. Upper edge portion 130 of the lever 120 preferably contacts with such lower edge of the blade. A pin 132 pivotally connects lever 120 to handle 12' by way of pin 132 passing through an aperture 136 defined on each side of the handle and an aperture 138 defined at a medial portion of lever 120. Lever 120 also includes a spring recess 140 for receipt of spring 142 which bears against a spring surface 144 of recess 122 defined in handle 12'. Again, it is to be understood that while a coil spring is indicated, a leaf spring could also be used, or a spring integrally formed or molded within the handle could also be used.

Pivoting lever 120, during normal operation, would be biased for holding blade 14 within the blade cavity, when the blade is in a retracted position. When the blade is to be withdrawn from the blade cavity, the user would simply pull the blade out of the blade cavity, thereby working against the pivoting lever to overcome the force exerted by lever 120 against the bottom edge of the blade. Pivoting lever 120 could also be configured for requiring the user to depress the opposite end 148 thereof in order to pull the blade from the blade cavity, if desired.

The present invention discloses, in addition to the methods described above for unlocking the blade from an extended position, and locking tool members in a variety of configurations, also encompasses a method of assembling a knife and tool device which would include providing a handle with the blade locking and blade back spring-type devices discussed above.

Construction of a knife and tool device as presently described yields a relatively lightweight design which should be comparatively economical to manufacture. The present design provides not only a locking folding knife design which is useable within only one hand, but also provides multiple tool members which can be readily extended and locked into place for operational use. Although the tool members indicated are of conventional Phillips and flat-blade screwdriver designs, the tool members could also include pick, hex, Allen wrenches, torx tools, files, blades, scribers, wrenches, scissors, pliers, or the like, which could be provided instead of or in addition to the tool members illustrated. Additionally, an implement other than a knife blade could be provided for receipt within handle cavity 42, if desired.

Tool members 18 could also be of a telescoping nature to telescope outwardly from the handle after being extracted from the tool cavity and could be a device such as a pointer used in giving presentations, lectures, or the like. Additionally, by virtue of the tool arbor arrangement disclosed, the tools can be locked in a variety of angular configurations with respect to the handle to allow for access and operation of the tool members to reach hard-to-access items or fasteners, such as screws, bolts, nuts, or the like.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A locking mechanism for a folding implement having a handle with first and second spaced apart handle walls defining an implement compartment therebetween and an implement pivotally connected to the handle for pivoting substantially in a first plane between a retracted position adjacent the handle walls to an extended position extending outwardly from the handle, the implement having an extreme end substantially exposed to the compartment when in the extended position, the locking mechanism comprising:

a locking member having a first end and a second end opposite said first end, said first end being pivotally connected to said first handle wall for movement in a plane substantially perpendicular to said first plane between an unlocking position, for allowing movement of the implement with respect to the handle, and a locking position, wherein said second end abuts the extreme end of the implement when the implement is in extended position for locking the implement in the extended position;

an axle carried in said first wall and passing through said first end of said locking member for allowing said locking member to pivot within said implement compartment; and a spring contacting said locking member and said first handle wall for biasing said locking member towards said locking position.

2. A locking mechanism as defined in claim 1, wherein said implement is a knife blade.

3. A locking mechanism as defined in claim 1, further comprising said first handle wall defining a recess adjacent the implement compartment for receipt of said locking member when said locking member is pivoted to said unlocking position.

4. A tool and implement holder, comprising:

an elongated body member having two ends, a top portion and a bottom portion and first and second side portions, said first and second side portions defining an elongated implement cavity therebetween;

an implement pivotally connected to said body member for pivoting movement substantially within a first plane between an extended position, extending outwardly from said body member, and a retracted position, wherein said implement is received in said implement cavity of said body member; and at least one tool member pivotally connected to said body member for pivoting substantially in a second plane with respect to said body member, said second plane extending at an angle with respect to said first plane;

said tool member being configured for pivoting between an extended position, extending outwardly from said body member, and a retracted position, adjacent at least one of said first and second side portions;

a locking member having a first end and a second end opposite said first end, said first end being pivotally connected to said first side portion for movement in a third plane substantially perpendicular to said first plane between an unlocking position, for allowing movement of the implement with respect to the body member, and a locking position, wherein said second end abuts the extreme end of the implement when the implement is in extended position for locking the implement in the extended position;

an axle carried in said first side portion and passing through said first end of said locking member for allowing said locking member to pivot within said implement cavity; and a spring contacting said locking member and said first side portion for biasing said locking member towards said locking position.

5. A tool and implement holder as defined in claim 4, further comprising locking means associated with said tool member for selectively locking the tool member with respect to said body member.

6. A tool and implement holder as defined in claim 4, wherein said body member has an integral elongated back spring.

7. A tool and implement holder, comprising:

an elongated body member having two ends, a top portion and a bottom portion and first and second side portions, said first and second side portions defining an elongated implement cavity therebetween;

an implement pivotally connected to said body member for pivoting movement substantially within a first plane between an extended position, extending outwardly from said body member, and a retracted position, wherein said implement is received in said implement cavity of said body member;

at least one tool member pivotally connected to said body member for pivoting substantially in a second plane with respect to said body member, said second plane extending at an angle with respect to said first plane;

said tool member being configured for pivoting between an extended position, extending outwardly from said body member, and a retracted position, adjacent at least one of said first and second side portions;

locking means associated with said tool member for selectively locking the tool member with respect to said body member, said locking means including: a threaded elongated member carried by said body; and a threaded adjustment nut threadingly received on said elongated member; and said tool defining a receptacle for receiving said elongated member, wherein upon said receptacle receiving said elongated member, said adjustment nut is adjacent said tool and is selectively contactable with said tool for locking said tool with respect to said handle.

8. A tool and implement holder, comprising:

an elongated body member having two ends, a top portion and a bottom portion and first and second side portions, said first and second side portions defining an elongated implement cavity therebetween;

an implement pivotally connected to said body member for pivoting movement substantially within a first plane between an extended position, extending outwardly from said body member, and a retracted position, wherein said implement is received in said implement cavity of said body member; and at least one tool member pivotally connected to said body member for pivoting substantially in a second plane with respect to said body member, said second plane extending at an angle with respect to said first plane;

said tool member being configured for pivoting between an extended position, extending outwardly from said body member, and a retracted position, adjacent at least one of said first and second side portions;

a locking member having a first end and a second end opposite said first end, said first end being pivotally connected to said first side portion for movement in a third plane substantially perpendicular to said first plane between an unlocking position, for allowing movement of the implement with respect to the body member, and a locking position, wherein said second end abuts the extreme end of the implement when the implement is in extended position for locking the implement in the extended position;

an axle passing through said first end of said locking member for allowing said locking member to pivot within said implement cavity;

a coil spring contacting said locking member and said first side portion for biasing said locking member towards said locking position; and tool locking means associated with said tool member for selectively locking the tool member with respect to said body member.

9. A method of locking a tool member with respect to a handle, comprising:

providing a handle;

providing a tool member;

connecting said tool member to said handle with a threaded elongated member;

providing a threaded adjustment member on said threaded elongated member contactable with said tool member;

positioning said tool member in a predetermined position with respect to said handle; and rotating said threaded adjustment member about said threaded elongated member such that said threaded adjustment member contacts and locks said tool member with respect to said handle.

10. A folding implement device, comprising:

a handle defining an implement compartment, said handle defining first and second side portions spaced apart from one another;

an implement pivotally connected to said handle for pivoting substantially in a first plane between a retracted position at least partially within said implement compartment to an extended position extending outwardly from said handle, said implement having an extreme end substantially exposed to said implement compartment when in said extended position;

a locking member having a first end and a second end opposite said first end, said first end being connected to said first side portion for movement between an unlocked position, for allowing movement of said implement with respect to said handle, and a locked position, wherein said second end abuts the extreme end of said implement when the implement is said extended position for locking said implement in said extended position;

at least one tool member pivotally connected to said handle for pivoting substantially in a second plane with respect to said handle, said second plane extending at an angle with respect to said first plane;

said tool member being configured for pivoting between an extended position, extending outwardly from said handle, and a retracted position, adjacent at least one of said first and second side portions of said handle;

an axle carried by said first side portion and passing through said first end of said locking member for allowing said locking member to pivot within said implement compartment in a third plane substantially perpendicular to said first plane; and a spring contacting said locking member and said first side portion for biasing said locking member towards said locking position.

11. A locking mechanism as defined in claim 10, wherein said implement is a knife blade.

12. A locking member as defined in claim 10, further comprising said first side portion defining a recess adjacent said implement compartment for receipt of said locking member when said locking member is moved to said unlocking position.

* * * * *